US009044914B2

(12) United States Patent
Guest et al.

(10) Patent No.: US 9,044,914 B2
(45) Date of Patent: Jun. 2, 2015

(54) PERMEABLE MATERIAL COMPACTING METHOD AND APPARATUS

(75) Inventors: Randall V. Guest, Spring, TX (US); Charles Edward Fowler, Cypress, TX (US); Bennett M. Richard, Kingwood, TX (US)

(73) Assignee: Baker Hughes Incorporated, Houston, TX (US)

( * ) Notice: Subject to any disclaimer, the term of this patent is extended or adjusted under 35 U.S.C. 154(b) by 734 days.

(21) Appl. No.: 13/170,320

(22) Filed: Jun. 28, 2011

(65) Prior Publication Data

US 2013/0000498 A1 Jan. 3, 2013

(51) Int. Cl.
*B30B 11/22* (2006.01)
*B30B 15/34* (2006.01)

(52) U.S. Cl.
CPC ..... *B30B 11/222* (2013.01); *B30B 15/34* (2013.01)

(58) Field of Classification Search
CPC ..... B30B 11/222; B30B 15/34
USPC ..... 100/35, 38, 42, 327, 329, 332, 334, 100/155 R, 159, 176, 158 R
See application file for complete search history.

(56) References Cited

U.S. PATENT DOCUMENTS

| | | | | |
|---|---|---|---|---|
| 1,352,493 | A | | 9/1920 | Wolffgram |
| 3,089,187 | A | | 5/1963 | Wolfe |
| 3,099,318 | A | | 7/1963 | Miller et al. |
| 3,205,289 | A | | 9/1965 | Carpenter |
| 3,371,793 | A | | 3/1968 | Fowler |
| 3,408,925 | A | * | 11/1968 | Bushmeyer ..... 100/45 |
| 3,494,281 | A | * | 2/1970 | Warnking ..... 100/86 |
| 3,515,610 | A | * | 6/1970 | Comastri et al. ..... 156/62.8 |
| 3,520,250 | A | * | 7/1970 | Molitorisz ..... 100/89 |
| 3,566,653 | A | | 3/1971 | Unrath |
| 3,695,076 | A | | 10/1972 | Kocks |
| 3,892,832 | A | | 7/1975 | Schey |
| 3,933,557 | A | | 1/1976 | Pall |
| 4,214,612 | A | | 7/1980 | de Putter |
| 4,260,096 | A | | 4/1981 | Samarynov et al. |
| 4,358,064 | A | | 11/1982 | Garneau |
| 4,363,845 | A | | 12/1982 | Hartmann |
| 4,474,845 | A | | 10/1984 | Hagerman et al. |
| 4,518,340 | A | | 5/1985 | Jakobsen et al. |
| 4,545,947 | A | | 10/1985 | Bozoarth et al. |
| 4,577,481 | A | | 3/1986 | Staat |

(Continued)

FOREIGN PATENT DOCUMENTS

| | | |
|---|---|---|
| EP | 0177167 A1 | 4/1986 |
| JP | 06-047219 A | 2/1994 |

(Continued)

OTHER PUBLICATIONS

Notification of Transmittal of the International Search Report and the Written Opinion of the International Searching Authority; PCT/US2012/021273; Korean Intellectual Property Office; Mailed Sep. 26, 2012; 8 pages.

(Continued)

*Primary Examiner* — Jimmy T Nguyen
(74) *Attorney, Agent, or Firm* — Cantor Colburn LLP

(57) ABSTRACT

A permeable material compacting method includes feeding permeable material between at least one set of rollers, and decreasing a cross sectional area of the permeable material as it passes between the at least one set of rollers.

16 Claims, 8 Drawing Sheets

(56) References Cited

U.S. PATENT DOCUMENTS

| | | | | |
|---|---|---|---|---|
| 4,592,782 | A | 6/1986 | Davies | |
| 4,621,999 | A | 11/1986 | Gerhardt | |
| 4,807,525 | A | 2/1989 | de Brock | |
| 4,816,106 | A | 3/1989 | Turris et al. | |
| 4,924,568 | A | 5/1990 | Sato et al. | |
| 4,976,915 | A | 12/1990 | Kuroki | |
| 5,032,622 | A | 7/1991 | Herrington et al. | |
| 5,049,591 | A | 9/1991 | Hayashi et al. | |
| 5,098,776 | A | 3/1992 | Kobayashi et al. | |
| 5,120,380 | A | 6/1992 | Strachan | |
| 5,207,960 | A | 5/1993 | Moret de Rocheprise | |
| 5,230,726 | A | 7/1993 | Smith et al. | |
| 5,242,651 | A | 9/1993 | Brayden et al. | |
| 5,324,117 | A | 6/1994 | Matsushita et al. | |
| 5,429,847 | A | 7/1995 | Ando et al. | |
| 5,460,085 | A * | 10/1995 | Cappellari et al. | 100/37 |
| 5,501,832 | A | 3/1996 | Adams | |
| 5,503,784 | A | 4/1996 | Balk | |
| 5,520,758 | A | 5/1996 | Kelman et al. | |
| 5,533,370 | A | 7/1996 | Kuroda et al. | |
| 5,565,049 | A | 10/1996 | Simmons et al. | |
| 5,640,900 | A * | 6/1997 | Walton | 100/35 |
| 5,770,016 | A | 6/1998 | Greve | |
| 5,827,430 | A * | 10/1998 | Perry et al. | 210/497.01 |
| 5,964,798 | A | 10/1999 | Imran | |
| 6,281,289 | B1 | 8/2001 | Maugans et al. | |
| 6,302,676 | B1 | 10/2001 | Kato et al. | |
| 6,321,503 | B1 | 11/2001 | Warren | |
| 6,342,283 | B1 | 1/2002 | Mozelack et al. | |
| 6,388,043 | B1 | 5/2002 | Langer et al. | |
| 6,472,449 | B1 | 10/2002 | Heinemann et al. | |
| 6,521,555 | B1 | 2/2003 | Bodaghi et al. | |
| 6,560,942 | B2 | 5/2003 | Warren et al. | |
| 6,583,194 | B2 | 6/2003 | Sendijarevic | |
| 6,769,484 | B2 | 8/2004 | Longmore | |
| 6,817,441 | B2 | 11/2004 | Murakami et al. | |
| 6,827,764 | B2 | 12/2004 | Springett et al. | |
| 6,935,432 | B2 | 8/2005 | Nguyen | |
| 6,983,796 | B2 | 1/2006 | Bayne et al. | |
| 6,986,855 | B1 | 1/2006 | Hood et al. | |
| 7,048,048 | B2 | 5/2006 | Nguyen et al. | |
| 7,134,501 | B2 | 11/2006 | Johnson et al. | |
| 7,155,872 | B2 | 1/2007 | Francom | |
| 7,234,518 | B2 | 6/2007 | Smith | |
| 7,552,767 | B2 | 6/2009 | Wood | |
| 7,644,773 | B2 | 1/2010 | Richard | |
| 7,677,321 | B2 | 3/2010 | Spray | |
| 7,712,529 | B2 | 5/2010 | Dusterhoft et al. | |
| 7,743,835 | B2 | 6/2010 | Willauer | |
| 7,828,055 | B2 * | 11/2010 | Willauer et al. | 166/228 |
| 2002/0144822 | A1 | 10/2002 | Hackworth et al. | |
| 2003/0213380 | A1 | 11/2003 | Sebastian et al. | |
| 2004/0241410 | A1 | 12/2004 | Fischer et al. | |
| 2005/0056425 | A1 | 3/2005 | Grigsby et al. | |
| 2005/0126699 | A1 | 6/2005 | Yen et al. | |
| 2005/0173130 | A1 | 8/2005 | Richard | |
| 2005/0205263 | A1 | 9/2005 | Richard | |
| 2005/0272211 | A1 | 12/2005 | Browne et al. | |
| 2006/0228963 | A1 | 10/2006 | Souther et al. | |
| 2007/0044891 | A1 | 3/2007 | Sellars et al. | |
| 2007/0211970 | A1 | 9/2007 | Nagata et al. | |
| 2008/0006413 | A1 | 1/2008 | Le Gloahec et al. | |
| 2008/0296020 | A1 | 12/2008 | Willauer | |
| 2008/0296023 | A1 | 12/2008 | Willauer | |
| 2009/0252926 | A1 | 10/2009 | Henderson et al. | |
| 2009/0301635 | A1 | 12/2009 | Corre et al. | |
| 2009/0319034 | A1 | 12/2009 | Sowinski | |
| 2010/0038076 | A1 | 2/2010 | Spray et al. | |
| 2010/0144247 | A1 | 6/2010 | Lunn et al. | |
| 2011/0178237 | A1 | 7/2011 | Ono et al. | |

FOREIGN PATENT DOCUMENTS

| | | |
|---|---|---|
| JP | 6-210318 | 8/1994 |
| JP | 6210309 A | 8/1994 |
| JP | 3279962 B2 | 4/2002 |
| WO | 2004099560 A1 | 11/2004 |
| WO | 2007106429 | 9/2007 |

OTHER PUBLICATIONS

Notification of Transmittal of the International Search Report and the Written Opinion of the International Searching Authority, PCT/US2011/031768; Mailed Sep. 30, 2011; Korean Intellectual Property Office, pp. 1-8.

G. Scott Lester et al., "Field Application of a New Cleanable and Damage Tolerant Downhole Screen,"; Society of Petroleum Engineers, SPE Paper No. 30132, May 15, 1995.

Jiaxing (Jason) Ren et al., "Studying the Effect of Chemical Aging on the Properties of a Shape Memory Material", Offshore Technology Conference, Paper No. OTC 21317; May 2, 2011.

Notification of Transmittal of the International Search Report and the Written Opinion of the International Searching Authority; PCT/US2012/041239; Mailed Jan. 2, 2013; Korean Intellectual Property Office; 9 pages.

Notification of Transmittal of the International Search Report and the Written Opinion of the International Searching Authority; PCT/US2012/048795; Mailed Feb. 14, 2013; Korean Intellectual Property Office; 10 pages.

Notification of Transmittal of the International Search Report and the Written Opinion of the International Searching Authority; PCT/US2012/048796; Mailed Feb. 8, 2013, Korean Intellectual Property Office; 6 pages.

Notification of Transmittal of the International Search Report and the Written opinion of the International Searching Authority; PCT/US2012/048798; Mailed Feb. 20, 2013, Korean Intellectual Property Office; 8 pages.

International Search Report and Written Opinion, International Application No. PCT/US2012/021274, Date of Mailing Aug. 17, 2012, Korean Intellectual Property Office, International Search report 5 pages, Written Opinion 7 pages.

J. Heiland et al., "The Role of the Annular Gap in Expandable Sand Screen Completions"; Society of Petroleum Engineers; SPE Paper No. 86463; Feb. 18-20, 2004.

Lorrie A. Krebs et al., "Pitting Resistance of Nitinol Stents Before and After Implantation"; NACE International; Paper No. 09461; Corrosion Conference and Expo Mar. 22-26, 2009.

Witold M. Sokolowski et al., "Cold hibernated elastic memor(yC HEM) self-deployable structures"; Jet Propulsion Laboratory, California Institute of Technology, Mar. 1, 1999.

SPE Distinguished Lecturer Series[online]; retrieved on Sep. 25, 2009]; retrieved from the Internet at: http://www.spe.org/spe-site/spe/spe/events/dl/Ott.pdf.

C.F. Williams et al., "A New Sizing Criterion for Conformable and Nonconformable Sand Screens Based on Uniform Pore Structures"; Society of Petroleum Engineers, SPE Paper No. 98235; Feb. 15-17, 2006.

* cited by examiner

PERMEABLE MATERIAL COMPACTING METHOD AND APPARATUS

BACKGROUND

Gravel packing is a process used in the downhole industry to fill an annulus with gravel. Gravel packed by such a process is permeable to fluid while providing support to walls of a wellbore in an earth formation, for example. The support prevents erosion and other damage to the formation walls that could result if the gravel support were not present. Recent developments replace the gravel pack with permeable space conforming materials that can expand to fill an annulus after being deployed therein. Such materials, as those described in U.S. Pat. No. 7,828,055 granted to Willauer et al. on Nov. 9, 2010, the entire contents of which are incorporated herein by reference, require compaction or compression prior to being deployed. Methods and systems for compacting such materials are well received in the art.

BRIEF DESCRIPTION

Disclosed herein is a permeable material compacting method that includes feeding permeable material between at least one set of rollers, and decreasing a cross sectional area of the permeable material as it passes between the at least one set of rollers.

Further disclosed is a permeable material compacting apparatus including at least one set of rollers. The rollers are configured and oriented relative to one another to compact permeable material moved through the at least one set of rollers to thereby reduce a cross sectional area of the permeable material subsequent passing through the at least one set of rollers in comparison to a cross sectional area of the permeable material prior to passing through the at least one set of rollers.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
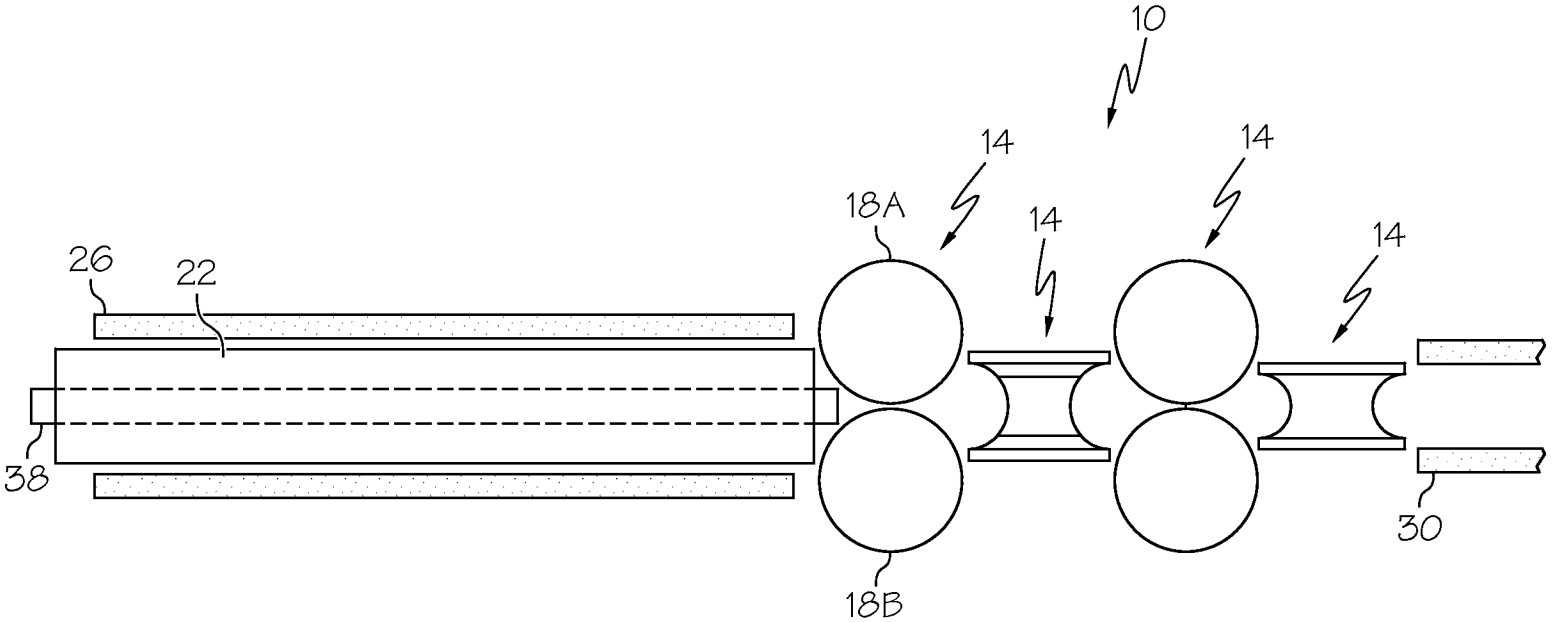
FIG. 1 depicts a side view of a permeable material compacting apparatus disclosed herein.
Figure 2:
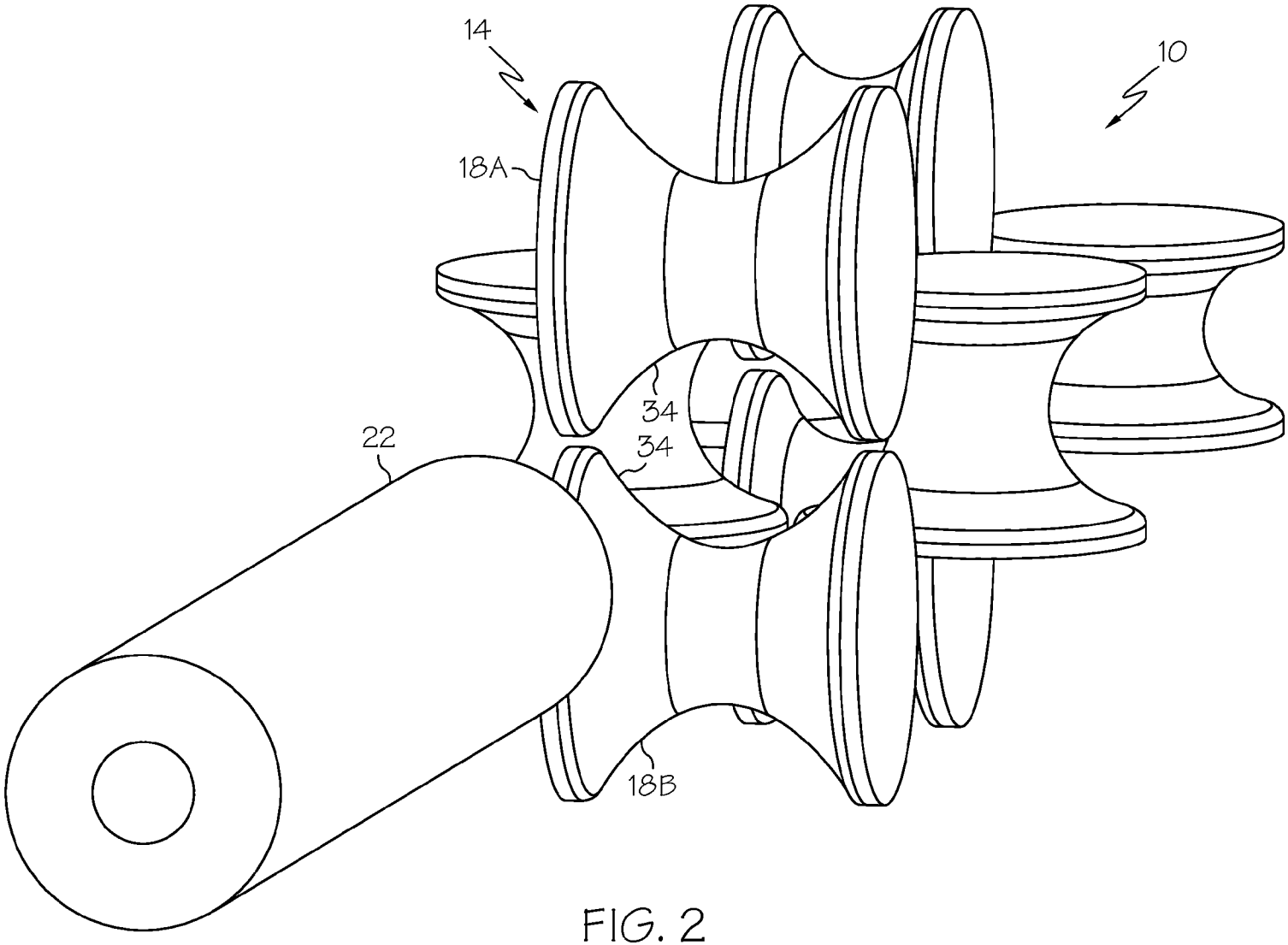
FIG. 2 depicts a perspective view of the permeable material compacting apparatus of FIG. 1.
Figure 3:
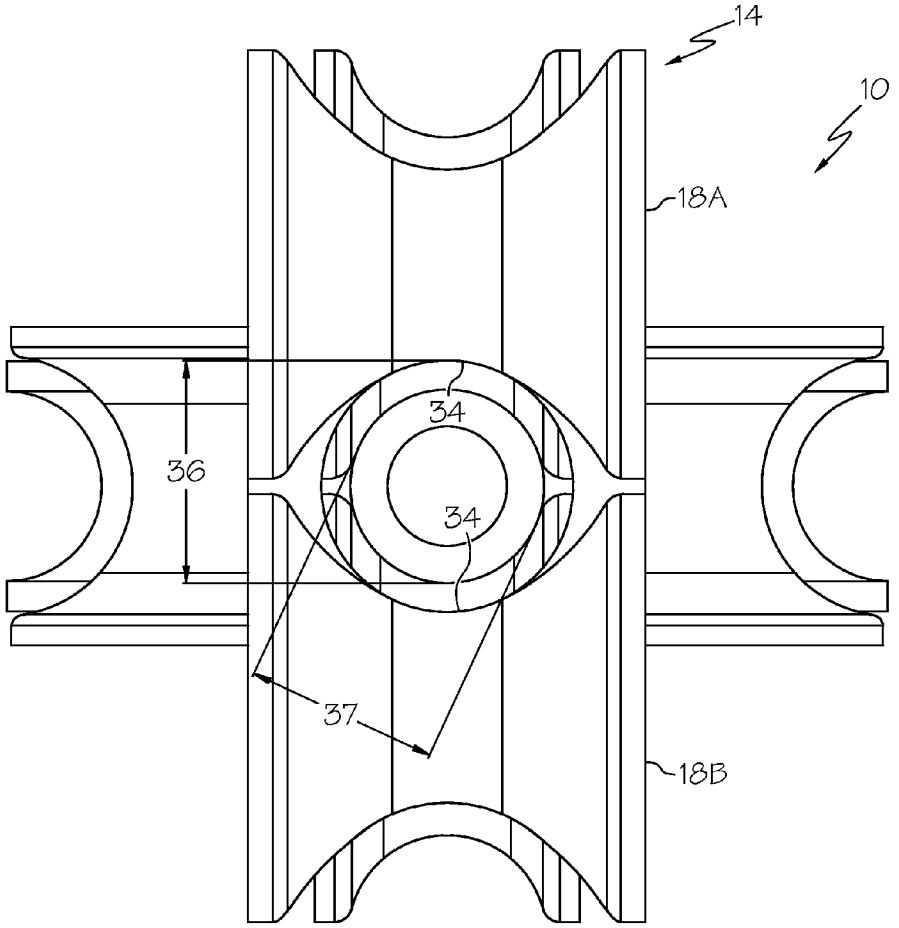
FIG. 3 depicts an end view of the permeable material compacting apparatus of FIG. 1.

Referring to FIGS. 1, 2 and 3, a permeable material compacting apparatus disclosed herein is illustrated at 10. The apparatus 10 includes, at least one set of rollers 14, with four sets of rollers 14 being shown in this embodiment. Each roller 18A of each of the sets of rollers 14 is oriented relative to the other roller(s) 18B of that particular set or rollers 14 such that permeable material 22, in the form of a billet for example, is compacted while passing between the rollers 18A and 18B. This compaction causes a decrease in cross sectional area of the permeable material 22 after passing between the rollers 18A, 18B when compared to a cross sectional area prior to the permeable material 22 passing between the rollers 18A, 18B.

The permeable material 22 may be foam, for example, or a mat formed from a plurality of strands built up randomly or in multiple layers. The permeable material 22 has shape memory such that it has internal forces, typically in the form of stresses, stored therewithin that urge the permeable material 22 to return to or near to a shape and size it had prior to compaction thereof. Such materials, after having been compressed, are subsequently expandable. Shape memory polymers and shape memory metals are a few examples of materials employable as the permeable material.

A heating device 26 (shown in FIG. 1 only) is positioned and configured to increase temperatures in the permeable material 22 prior to the permeable material 22 being compacted by the sets of rollers 14. Additionally, a cooling device 30 (also shown in FIG. 1 only) is positioned and configured to decrease temperatures in the permeable material 22 subsequent to the permeable material 22 being compacted by the sets of rollers 14. As such, the permeable material compacting apparatus 10 can cause the permeable material 22 to undergo a reduction in volume and then essentially freeze the permeable material 22 at the new reduced volume until the permeable material 22 is exposed to an environment, such as an increase in temperature in this embodiment, wherein the permeable material 22 is able to relieve the compaction stresses stored therein and expand toward the original and larger volume.

Each longitudinally displaced set of rollers 14 in the embodiment of FIGS. 1-3 is positioned substantially orthogonally to the other sets of rollers 14 adjacent thereto. As such, rotational axes of the rollers 18A, 18B in one set are oriented at right angles to the rotational axes of the rollers 18A, 18B of the sets of rollers 14 adjacent thereto. It should be noted that alternate embodiments are contemplated wherein adjacent sets of rollers 14 have rollers 18A, 18B with rotational axes oriented at angles other than 90 degrees. Each of the rollers 18A, 18B in the sets or rollers 14 shown have surfaces 34 engagable with the permeable material 22 that together approximate an ellipse. One can envision that the permeable material 22 exiting a first of the set of rollers 14 would have a cross sectional shape that approximates an ellipse. The same permeable material 22 exiting the second set of rollers 14 however may have a cross sectional shape that approximates a circle due to the orthogonal orientation of the elliptical shape the second set or rollers 14 imparts onto the permeable material 22.

Additionally, the third and the fourth sets of rollers 14 in the illustrated embodiment are oriented in a similar fashion to that of the first and the second sets of rollers 14, respectively. The third and fourth sets of rollers 14 differ from the first and second sets of rollers 14 in a dimension 36 defined between the surfaces 34 of one or the rollers 18A in relation to the other of the rollers 18B, with the third and fourth set of rollers 14 having a dimension 37 between the surfaces 34 that is smaller than the dimension 36 of the first and second set of rollers 14. This stepped reduction in dimension and consequently stepped reduction in cross sectional area (and volume) of the permeable material 22 allows for a more controlled process of volume reduction than if the total reduction in volume were completed in a single step. Additionally, one or more of the rollers 18A, 18B can be rotationally driven to aid in drawing the permeable material 22 through the sets of rollers 14. The stepped reduction in dimension makes possible, via friction forces, the driven volume reduction, without excess slipping at the rollers 14 or a required axial force, other than the force of traction by the rollers 14 on the permeable material 22.

An optional mandrel 38 (shown in FIG. 1 only) can be positioned within a bore through the permeable material 22. In addition to being configured to assist in heating and cooling of the permeable material 22, the mandrel 38 can allow the permeable material 22 to have a hollow cylindrical shape while still be compacted.

Figure 4:
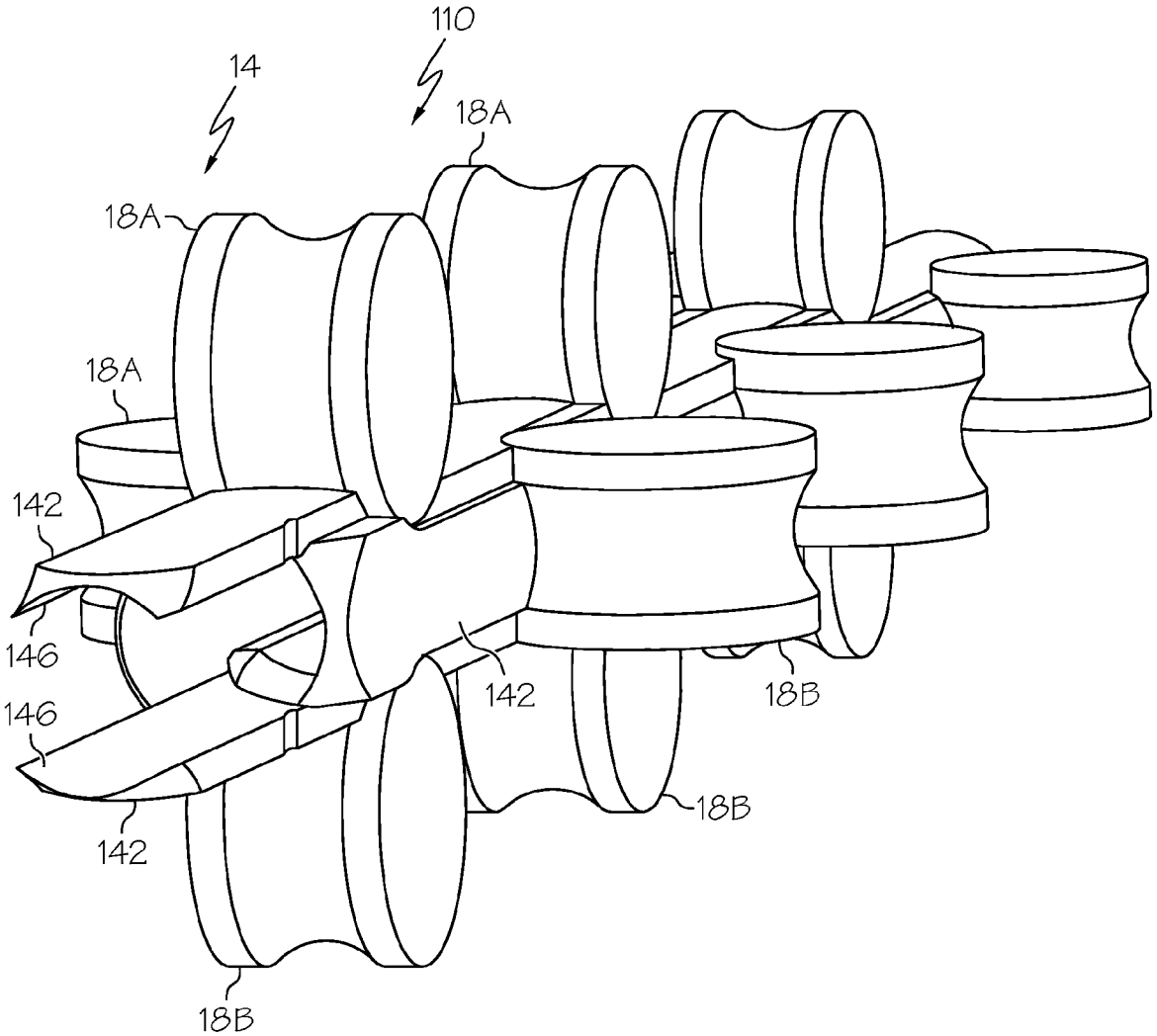
FIG. 4 depicts a perspective view of an alternate embodiment of a permeable material compacting apparatus disclosed herein.
Figure 5:
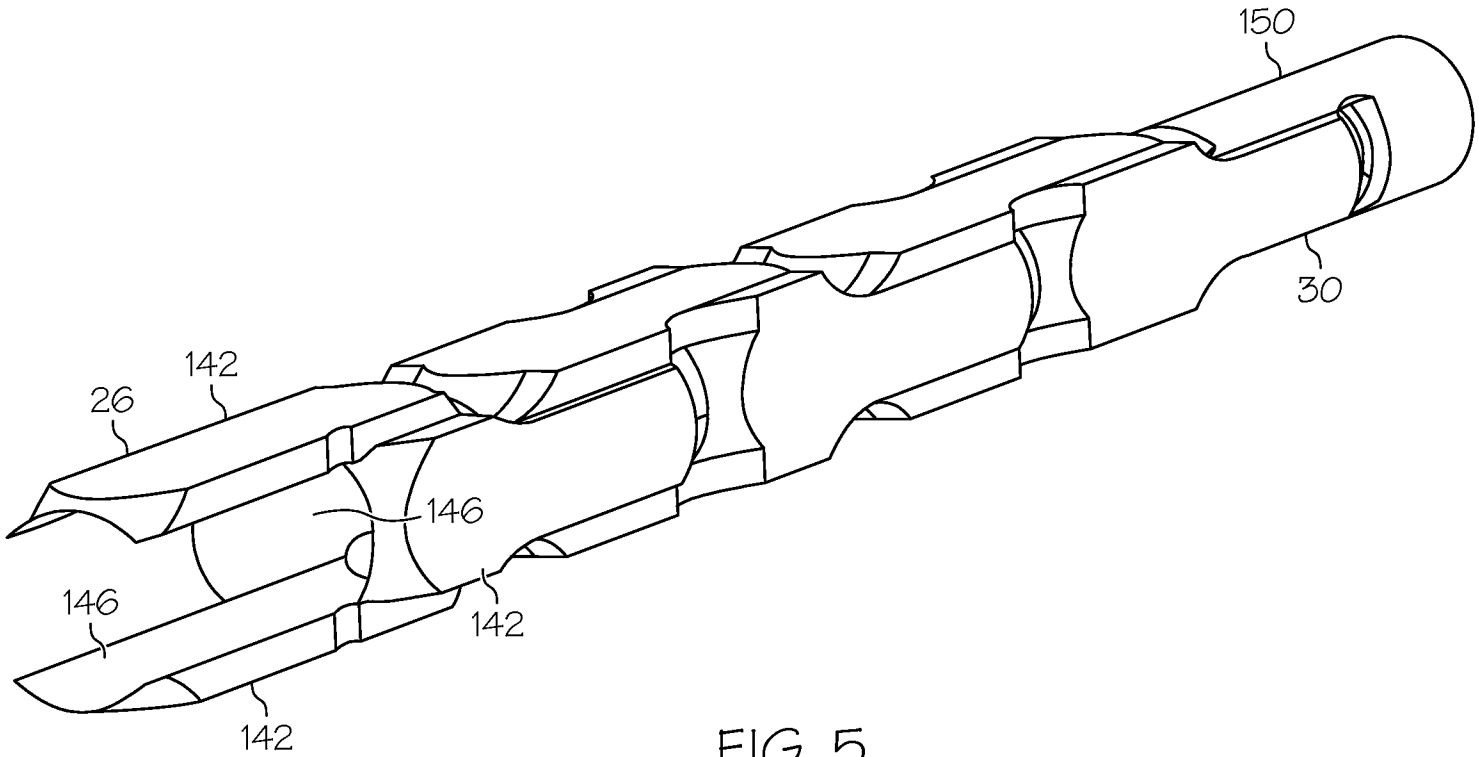
FIG. 5 depicts a perspective view of shaping forms employed in the permeable material compacting apparatus of FIG. 4.

Referring to FIGS. 4 and 5, an alternate embodiment of a permeable material compacting apparatus is illustrated at 110. The apparatus 110 is similar to that of apparatus 10 and as such only the differences will be described hereunder. The apparatus 110 includes shaping forms 142 that are shaped and configured to fit between the rollers 18A, 18B of one set of rollers 14 and the rollers 18A, 18B of another of the sets of rollers 14 to limit or prevent expansion of the permeable material 22 as it travels between adjacent sets of rollers 14. The shaping forms 142 have surfaces 146 that allow the permeable material 22 to slide along as it travels between the sets of rollers 14. The surfaces 146 are located and contoured relative to the rollers 18A, 18B to be engaged by the permeable material 22 right after the maximum compaction of the permeable material 22 has taken place to minimize expansion of the permeable material 22. The surfaces 146 continue to engage the permeable material 22 until it begins to be compacted by the next set of rollers 14.

An outlet portion 150 of the shaping forms 142 can serve as a final sizing form. The length of the outlet portion 150 can be selected based on parameters of the permeable material 22 and the apparatus 146 to assure, for example, that the permeable material 22 has cooled sufficiently that expansion will not take place upon exiting the outlet portion 150. Additionally, the shaping forms 142 can serve as one or both of the heating device 26 and the cooling device 30 to aid in altering temperatures in the permeable material 22 at the desired points on the way through the apparatus 110.

Figure 6:
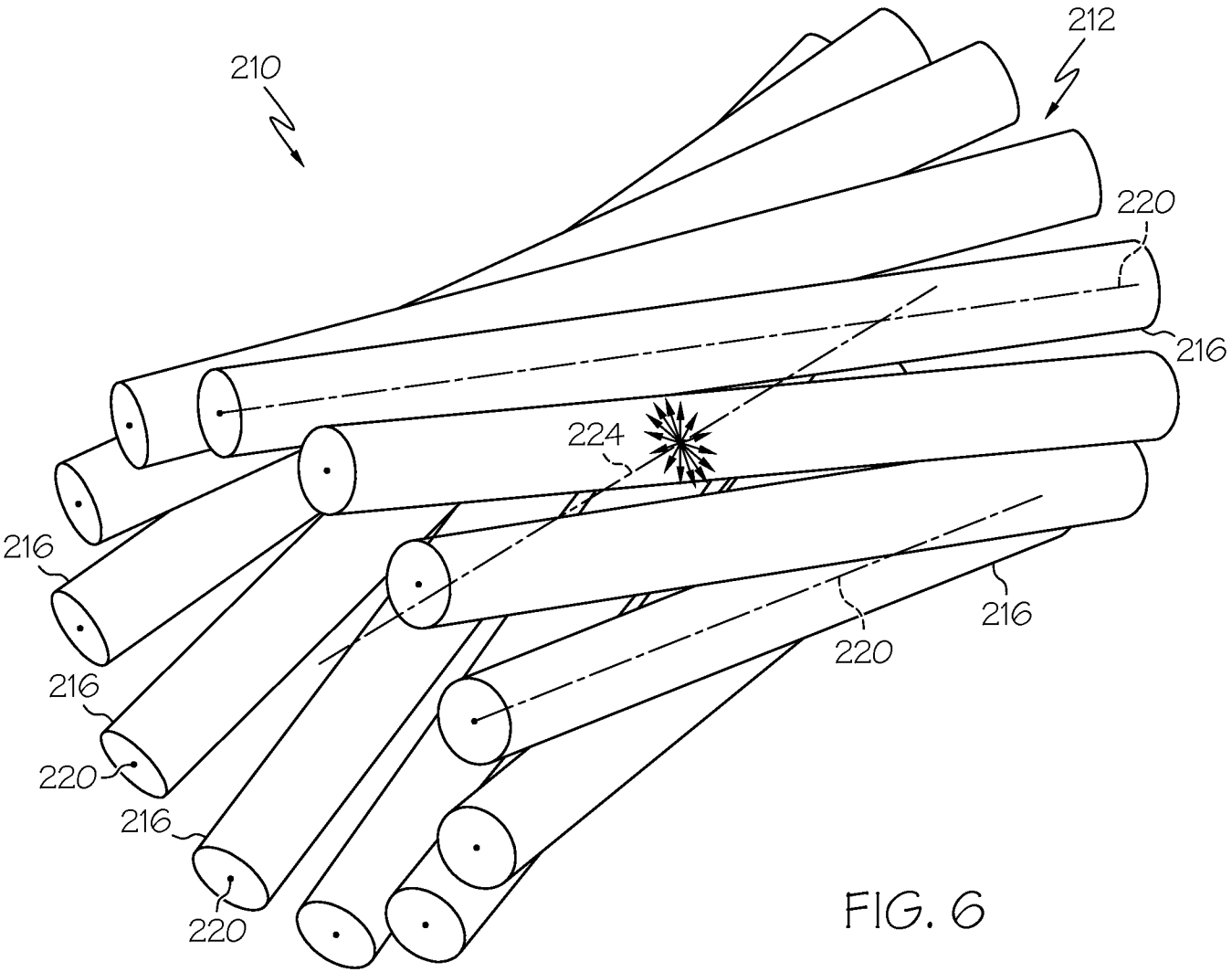
FIG. 6 depicts a perspective view of an alternate embodiment of a permeable material compacting apparatus disclosed herein.
Figure 7:
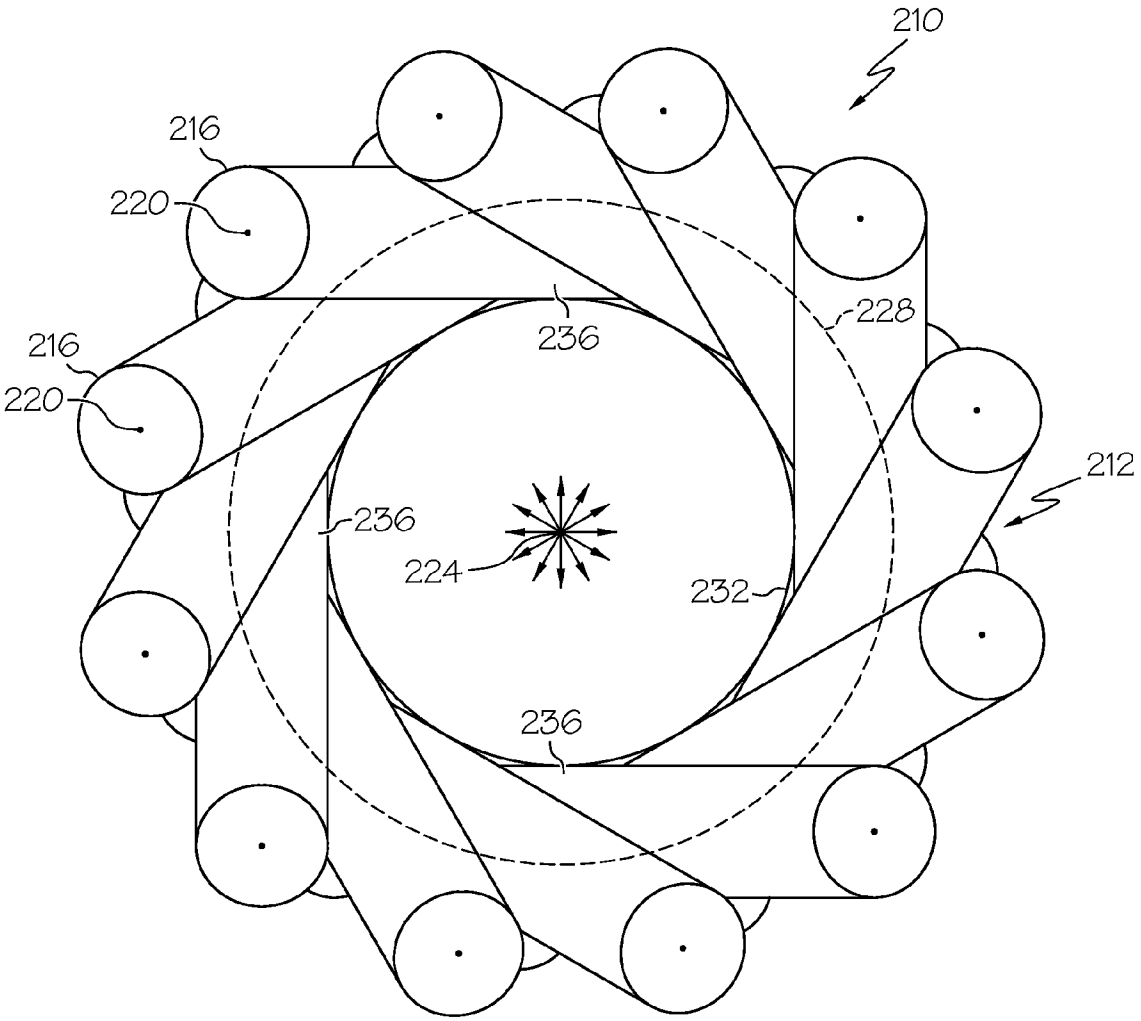
FIG. 7 depicts an end view of the permeable material compacting apparatus of FIG. 6.
Figure 8:
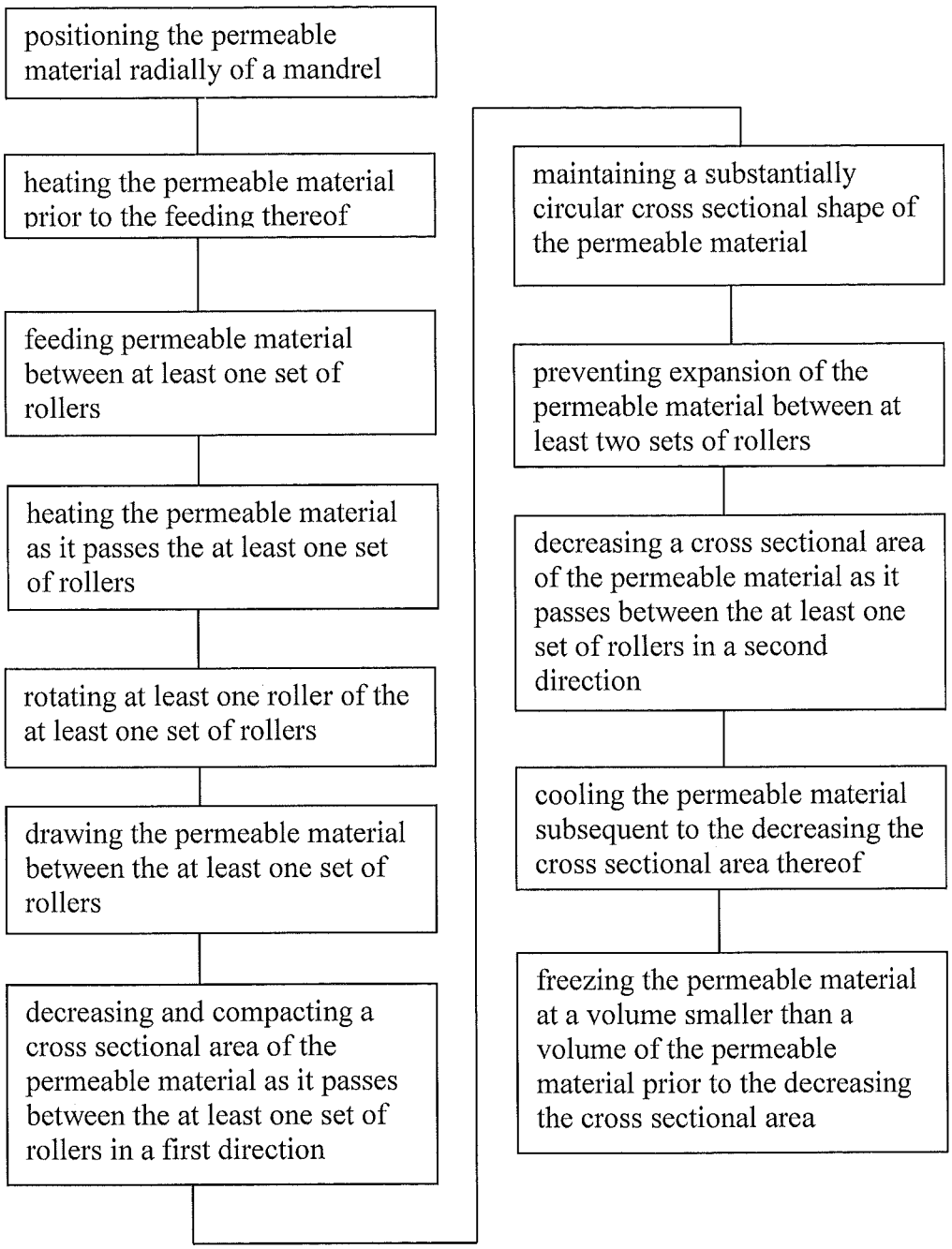
FIG. 8 depicts a flow diagram of steps included to carryout a permeable material compacting method disclosed herein.

Referring to FIGS. 6 and 7, another alternate embodiment of a permeable material compacting apparatus is illustrated at 210. Unlike the apparatuses 10 and 110, the apparatus 210 has a set of rollers 212 that includes a plurality of rollers 216 that each have a rotational axis 220 that is skewed relative to an axis 224 that defines a center of travel of the permeable material 22 through the apparatus 210 as well as being skewed relative to each of the other rollers 216. The definition of skewed as used herein meaning to be neither parallel to nor intersecting with. The rollers 216 being oriented as described and shown herein form a funnel shape, more specifically, centers of the rollers are substantially contained by a quadratic surface, the hyperbolic paraboloid. The permeable material 22 having an original perimeter 228 substantially simultaneously engages with every one of the rollers 216 when being fed therethrough. The engagement between the permeable material 22 and the rollers 216 continues until the permeable material 22 has been compacted to the point that final perimeter 232 is substantially equal to a minimum sized circle as defined by surfaces 236 of each of the plurality of rollers 216 as observed looking end on as in FIG. 7.

Although not shown in FIGS. 6 and 7, one should appreciate that alternately shaped shaping forms than the shaping forms 142 could be employed with the embodiment of apparatus 210 with one or more shaping forms engaging the permeable material 22 prior to engaging the rollers 216 and one or more shaping forms engaging the permeable material 22 upon exiting engagement with the rollers 216. Such shaping forms could also be heated and/or cooled to provide desired changes in temperature of the permeable material 22 at desired points while passing through the apparatus 210, as well as being a final sizing die for the permeable material 22 as it leaves the apparatus 210. Alternate embodiments could also employ a plurality of sets of rollers 216 with each successive set of rollers 216 defining different and perhaps smaller final perimeters.

One or more of the rollers 216 could also be rotationally driven to aid in drawing the permeable material 22 through the apparatus 210 in a similar fashion to the way the rollers 18A and 18B were driven in the apparatus 10.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A permeable material compacting method comprising:

feeding permeable material between at least one set of rollers;

rotating at least one roller of the at least one set of rollers about an axis that is skewed relative to an axis that defines a center of travel of the permeable material;

decreasing a cross sectional area of the permeable material as it passes between the at least one set of rollers; and freezing the permeable material at a volume smaller than a volume of the permeable material prior to the decreasing the cross sectional area.

2. The permeable material compacting method of claim 1, further comprising heating the permeable material prior to the feeding thereof.

3. The permeable material compacting method of claim 1, further comprising cooling the permeable material subsequent to the decreasing the cross sectional area thereof.

4. The permeable material compacting method of claim 1, wherein the decreasing a cross sectional area of the permeable material by one set of the at least one set of rollers is primarily in a direction that is different than the decreasing a cross sectional area of the permeable material by another set of rollers of the at least one set of rollers.

5. The permeable material compacting method of claim 1, wherein the decreasing a cross sectional area of the permeable material by one set of the at least one set of rollers is primarily in a direction orthogonal to the decreasing of a cross sectional area of the permeable material by another set of rollers of the at least one set of rollers.

6. The permeable material compacting method of claim 1, further comprising positioning the permeable material radially of a mandrel.

7. The permeable material compacting method of claim 1, wherein the decreasing the cross sectional area includes compacting.

8. The permeable material compacting method of claim 1, wherein the decreasing the cross sectional area is performed in steps with at least two sets of the at least one set of rollers being set to perform two of the steps.

9. The permeable material compacting method of claim 1, further comprising rotating at least one roller of the at least one set of rollers to assist in drawing the permeable material between the at least one set of rollers.

10. The permeable material compacting method of claim 1, wherein the decreasing the cross sectional area includes maintaining a substantially circular cross sectional shape of the permeable material.

11. The permeable material compacting method of claim 1, further comprising heating the permeable material as it passes the at least one set of rollers.

12. The permeable material compacting method of claim 1, further comprising rotating the at least one roller of the at least one set of rollers about an axis that is skewed relative to at least one other roller of the at least one set of rollers.

13. The permeable material compacting method of claim 1, further comprising rotating at least one roller of the at least one set of rollers about an axis that is orthogonal to the axis that defines a center of travel of the permeable material.

14. The permeable material compacting method of claim 1, further comprising rotating at least one roller of the at least one set of rollers about an axis that is skewed relative to an axis of the permeable material compacted by the at least one set of rollers.

15. The permeable material compacting method of claim 1, further comprising preventing expansion of the permeable material as it travels between at least two sets of rollers of the at least one set of rollers.

16. The permeable material compacting method of claim 1, further comprising radially compressing the permeable material.

* * * * *